US007505014B2

(12) United States Patent
Moon

(10) Patent No.: US 7,505,014 B2
(45) Date of Patent: Mar. 17, 2009

(54) APPARATUS FOR DRIVING PLASMA DISPLAY PANEL INCLUDING SCAN DRIVER

(75) Inventor: Seong Hak Moon, Seoul (KR)

(73) Assignee: LG Electronics, Inc., Seoul (KR)

( * ) Notice: Subject to any disclaimer, the term of this patent is extended or adjusted under 35 U.S.C. 154(b) by 498 days.

(21) Appl. No.: 11/069,941

(22) Filed: Mar. 3, 2005

(65) Prior Publication Data

US 2005/0195131 A1 Sep. 8, 2005

(30) Foreign Application Priority Data

Mar. 5, 2004 (KR) ..... 10-2004-0014805

(51) Int. Cl.
*G09G 3/28* (2006.01)

(52) U.S. Cl. ..... 345/60; 345/67; 345/41; 345/37

(58) Field of Classification Search ..... 345/60, 345/67, 41, 37
See application file for complete search history.

(56) References Cited

U.S. PATENT DOCUMENTS 5,517,207 A * 5/1996 Kawada et al. ..... 345/78
5,835,072 A * 11/1998 Kanazawa ..... 345/60
7,268,749 B2 * 9/2007 Marcotte et al. ..... 345/60
2002/0140639 A1 10/2002 Sakita ..... 345/60

FOREIGN PATENT DOCUMENTS

CN 1145508 5/2003

OTHER PUBLICATIONS

European Search Report dated Jan. 16, 2007.

* cited by examiner

*Primary Examiner*—Bipin Shalwala
*Assistant Examiner*—Afroza Y Chowdhury
(74) *Attorney, Agent, or Firm*—Ked & Associates LLP

(57) ABSTRACT

The present invention relates to an apparatus for driving a plasma display panel, and more particularly, to an apparatus for driving a plasma display panel including a scan driver. According to an embodiment of the present invention, an apparatus for driving a plasma display panel includes one switching device to apply a scan pulse per one Y-electrode wherein the switching device is turned on to apply the scan pulse to the selected Y-electrode and wherein other switching devices are turned off. By performing scan and sustain processes using one switching device only, the present invention reduces the costs and the volume of the scan driver. Specifically, by turning on the switching device corresponding to the selected channel only and by turning off the switching devices corresponding to other channels, the present invention minimizes power consumption.

25 Claims, 4 Drawing Sheets

APPARATUS FOR DRIVING PLASMA DISPLAY PANEL INCLUDING SCAN DRIVER

This Nonprovisional application claims priority under 35 U.S.C. § 119(*a*) on Patent Application No. 10-2004-0014805 filed in Korea on Mar. 5, 2004, the entire contents of which are hereby incorporated by reference.

BACKGROUND OF THE INVENTION

1. Field of the Invention

The present invention relates to an apparatus for driving a plasma display panel, and more particularly, to an apparatus for driving a plasma display panel including a scan driver.

2. Description of the Background Art

FIG. 1 is a block diagram of a plasma display panel driver according to a related art. Referring to FIG. 1, a signal processing unit 110 converts a video signal inputted form outside to video data suitable for a drive of a plasma display panel.

A data sort unit 120 reconfigures the video data of 1-TV field into a plurality of subfields for a gray scale processing of the video data converted by the signal processing unit 110.

An X-electrode drive unit 130 and a Y-electrode drive unit 140 apply an address pulse and a scan pulse for forming a wall voltage in a discharge cell of the plasma display panel to an X-electrode and a Y-electrode, respectively. And, the Y electrode drive unit 140 and a Z-electrode drive unit 150 alternately apply sustain pulses for sustaining a discharge of the discharge cell having the wall charge formed thereon to the Y-electrode and a Z-electrode, respectively.

A main control unit 160 controls video data re-sorted by the data sort unit 120 according to an external video signal so that the re-sorted video data is sequentially read to be supplied to the X-electrode drive unit 130 by 1-scan line quantity. And, the main control unit 160 applies a logic control pulse to a high voltage drive circuit unit 170.

The high voltage drive circuit unit 170 receives the logic control pulse from the main control unit 160 and then applies a high voltage control pulse to the X-, Y-, and Z-electrode drive units 130 140, and 150.

In this case, the Y-electrode drive unit 140 includes a scan driver 210, as shown in FIG. 2, to apply a scan or sustain pulse to the Y-electrode. The related art scan driver 210 is an integrated circuit (IC) package including a pair of switching devices. A pair of the switching devices, which form one channel to apply the scan or sustain pulse to the Y-electrode, need to employ switching devices having high strength. As the related art scan driver 210 consists of a pair of the high-strength switching devices, costs are raised and a volume of the IC package increases.

Moreover, for a channel that is not selected by the scan driver 210 in a scan process, first switching devices 211-1 to **211-*n*** are always turned on to hold a ground level. Hence, power consumption increases to cause more damage to the IC package.

For instance, if a cannel corresponding to a first Y-electrode Y1 is selected in the scan process, the rest of Y-channels Y2 to Yn are not selected. Once the corresponding channel is selected, a second switching device 213-1 of a first scan driver 210-1 corresponding to the selected channel is turned on as well as a scan switching device 220. Simultaneously, first switching devices 211-2 to **211-*n* of scan drivers 210-2 to 210-*n* corresponding to the unselected channels and a ground switching device 230** are turned on.

Once the switching devices are driven and once a data pulse is applied to the X-electrodes (X1 to Xm), a write operation is performed on a cell situated on a first line. Moreover, the data pulse is grounded via the first switching devices 211-2 to **211-*n* of the scan drivers 210-2 to 210-*n* corresponding to the rest of the Y-electrodes Y2 to Yn and the ground switching device 230**.

However, in doing so, since the unselected channels (n-1) outnumber the selected channel (1), the power consumption caused by the grounding is raised. And, it is also highly probable that power fluctuation within the IC package may break down the devices.

A reference number '240' in FIG. 2 is a switching device to apply a sustain voltage (+Vsy) to the Y-electrode, and a reference number '250' in FIG. 2 is a switching device to apply a sustain voltage (+Vsz) to the Z-electrode.

SUMMARY OF THE INVENTION

Accordingly, an object of the present invention is to solve at least the problems and disadvantages of the background art.

An object of the present invention is to provide an apparatus for driving a plasma display panel including a scan driver, by which a simple configuration and low power consumption can be provided.

In an apparatus for driving a plasma display panel, in which scan and sustain pulses are applied to each Y-electrode and a data pulse is applied to an X-electrode, a drive apparatus according to the present invention includes one switching device to apply the scan pulse per one Y-electrode. The switching device is turned on to apply the scan pulse to the selected Y-electrode and other switching devices are turned off.

By performing a scan process and a sustain process using one switching device only, the present invention can lower costs and decrease a volume of a scan driver. Specifically, the switching device corresponding to a selected channel is turned on only and the switching devices corresponding to other channels are turned off, whereby power consumption is minimized.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

According to an embodiment of the present invention, an apparatus for driving a plasma display panel includes one switching device to apply a scan pulse per one Y-electrode wherein the switching device is turned on to apply the scan pulse to the selected Y-electrode and wherein other switching devices are turned off.

The switching device applies the scan pulse of a negative voltage to the selected Y-electrode. And, a data pulse applied to an X-electrode is a positive voltage.

The apparatus for driving the plasma display panel according to the embodiment of the present invention furtner includes a diode turned on by an impression of a sustain pulse to allow the sustain pulse to be applied to the Y-electrode.

The switching device is turned off when the diode is turned on.

A cathode end of the diode is connected to one end of the switching device. And, an anode end of the diode is connected to the other end of the switching device.

Hereinafter, the embodiments of the present invention will be described with reference to the drawings.

Figure 1:
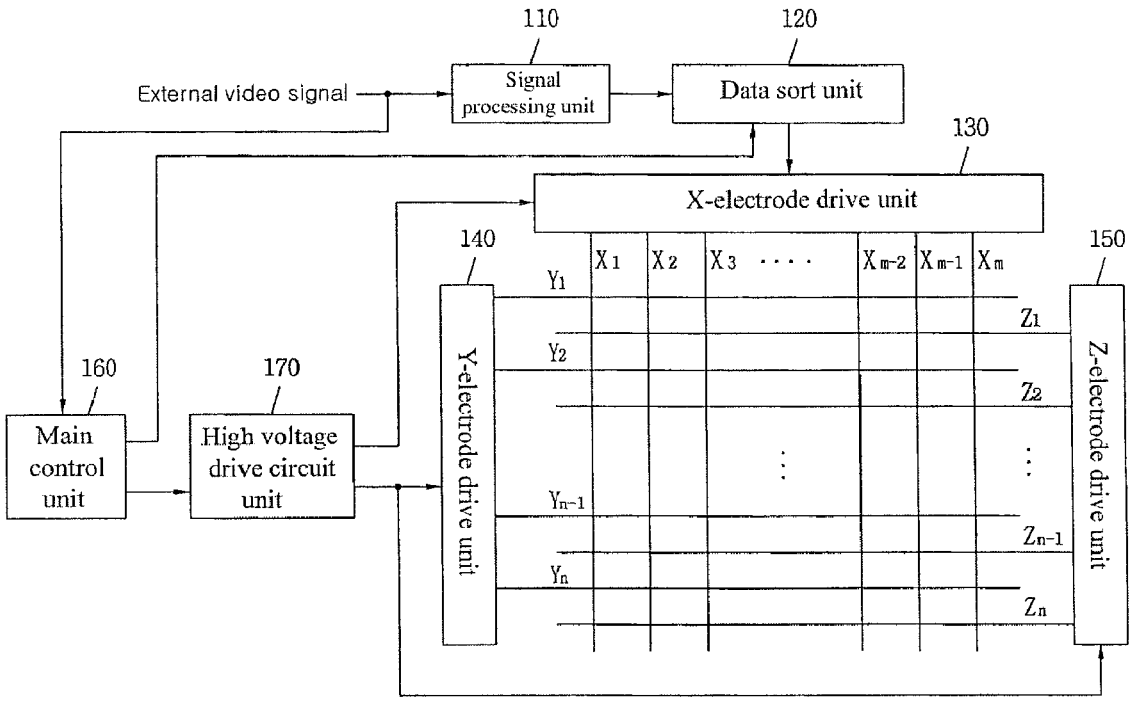
Fig. 1 Related Art
FIG. 1 is a block diagram of a drive apparatus for a plasma display panel according to a related art.
Figure 2:
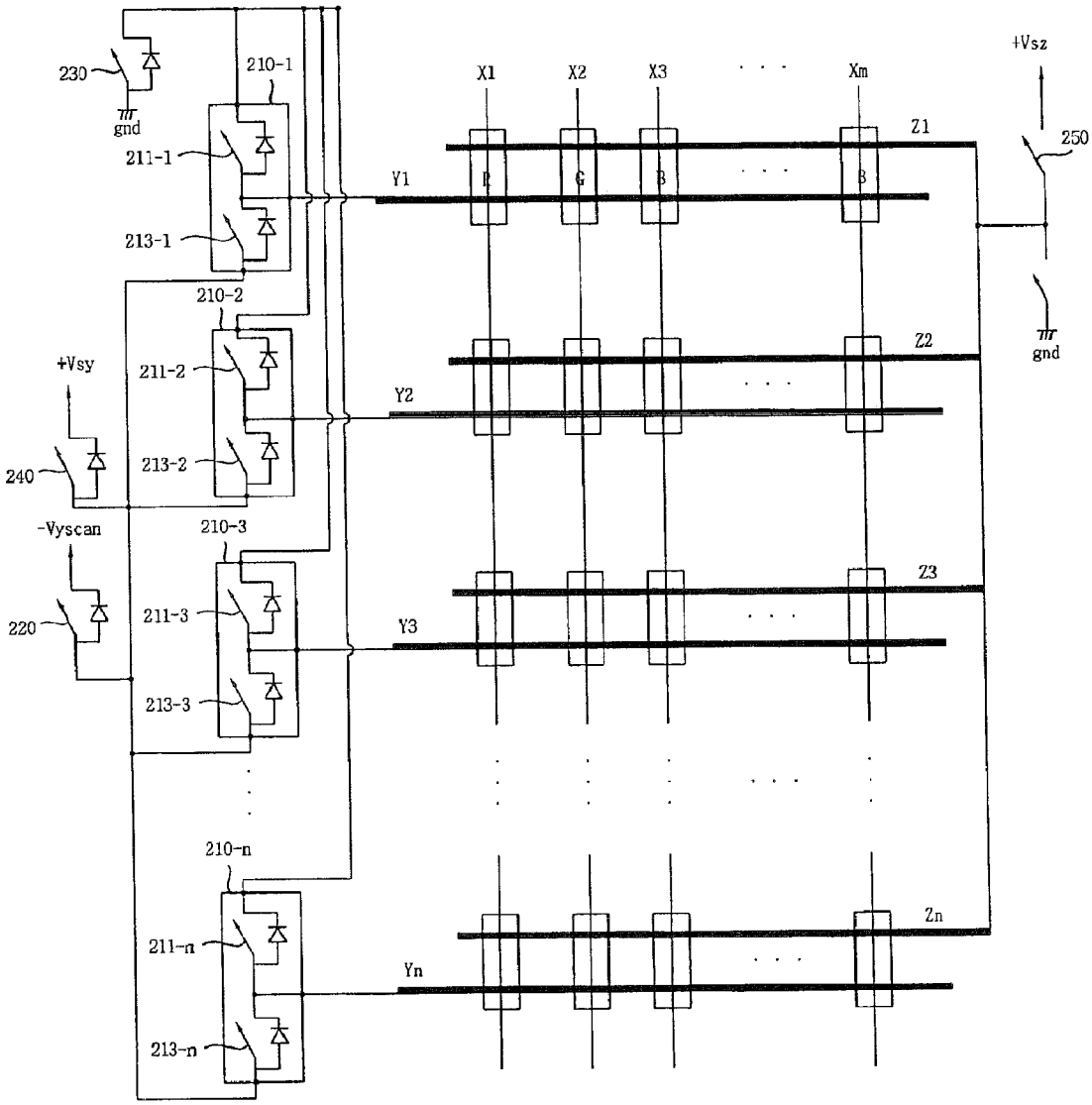
Fig. 2 Related Art
FIG. 2 is a circuit diagram of a drive apparatus for a plasma display panel including a scan driver according to a related art.
Figure 3:
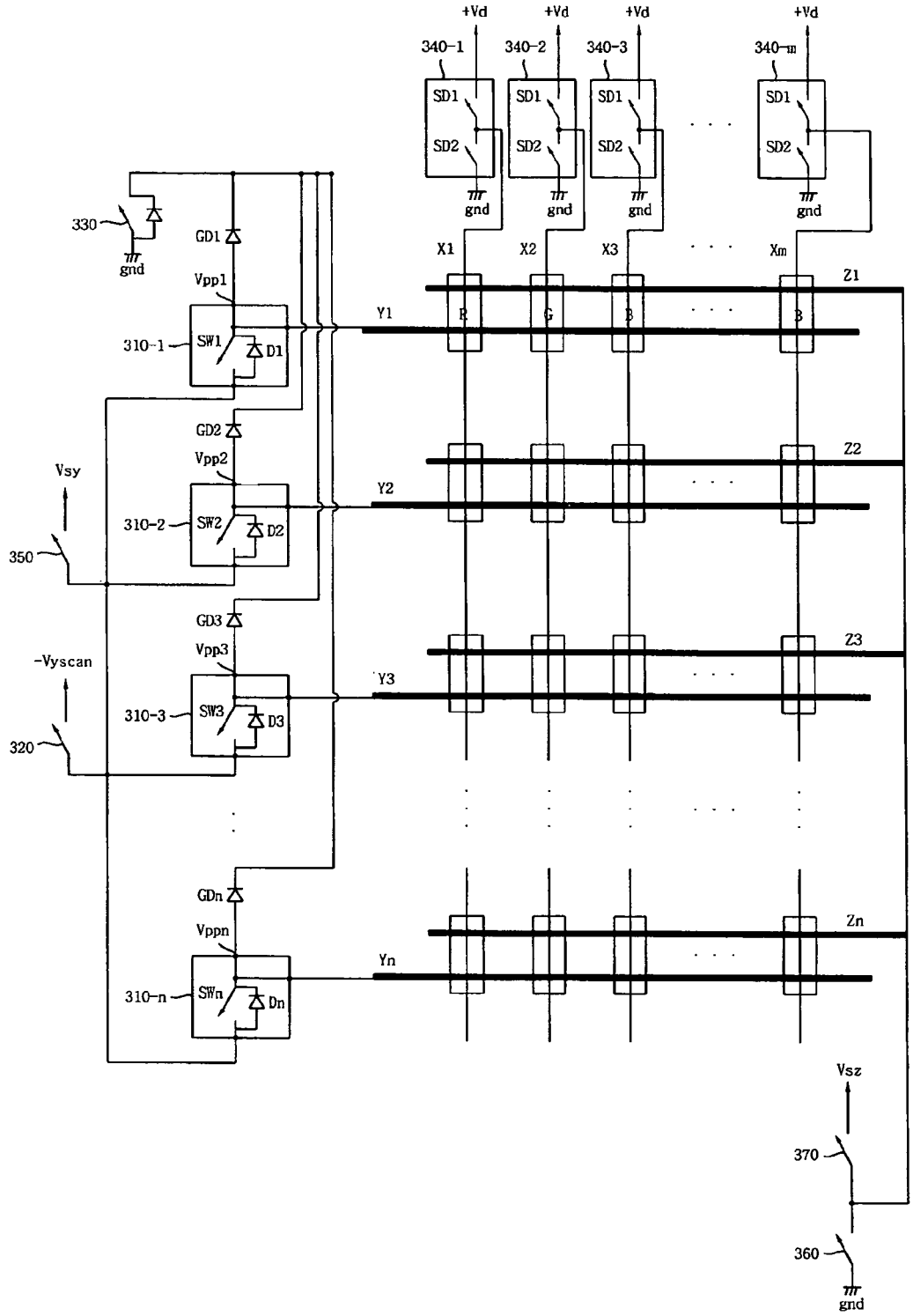
FIG. 3 is a circuit diagram of an apparatus for driving a plasma display panel including a scan driver according to the present invention.

FIG. 3 is a circuit diagram of an apparatus for driving a plasma display panel including a scan driver according to the present invention. Referring to FIG. 3, a scan driver according to the present invention includes a plurality of switching curcuits 310-1 to **310-*n* provided to a plurality of channels, respectively and a plurality of diodes D-1 to D-n. In this case, one end of each of the switching devices 310-1 to 310-*n* is connected to a corresponding one of a plurality of Y-electrodes Y1 to Yn of a corresponding channel. Each cathode end of the diodes D-1 to D-n is connected to one end of the corresponding switching device and each anode end of the diodes D-1** to D-n is connected to the other end of the corresponding switching device.

Operations of the scan driver according to the present invention in scan and sustain processes are explained in detail with reference to FIG. 3 as follows.

Once a ground switch device 330 is turned on, Vpp1 to Vppn terminals of all scan drivers 310-1 to **310-*n* are grounded. Namely, the Y-electrode corresponding to each channel has a ground level by a corresponding one of ground diodes GD1** to GDn.

Subsequently, outputs of data drivers 340-1 to **340-*m* and one of switching devices SW1** to SWn of a specific scan driver are turned on, and the switching devices of the rest of the scan drivers except the switching device of the specific scan driver keeps being turned off.

For instance, the switching device SW1 of the scan driver corresponding to the first Y-electrode Y1 is turned on and the switching devices SW2 to SWn of the rest of the scan drivers maintain their turned-off states. Hence, a voltage level of the first Y-electrode Y1 becomes Vy and a data pulse having a level of +Vd is applied to an X-electrode. A voltage difference between +Vd and Vy, i.e., Vy+Vd is applied to a cell to select. And, each voltage level of the rest of the unselected Y-electrodes becomes a ground level.

In this case, since the switching devices SW2 to SWn of the rest of the scan drivers are turned off, the corresponding power consumption is almost zero. Namely, in case of the related art scan drivers, the switching devices of the scan drivers corresponding to the unselected channels are turned on so that their levels become the ground level to raise the waste of power consumption. On the contrary, in the scan drivers according to the present invention, the scan drivers corresponding to the unselected channels prevent the power consumption wasted as one switching device turned off.

The entire scan drivers operate in the above explained manner to perform the scan process on the entire Y-electrodes. After completion of performing the scan process on the entire Y-electrodes, the corresponding scan driver performs a sustain drive.

In a sustain process, if a sustain switching device 350 and a ground switching device 360 are turned on and if the switching devices SW1 to SWn of the scan drivers are turned off, a loop including a sustain voltage source Vsy, diodes D1 to Dn of the scan drivers, the Y-electrodes, cells, Z-electrodes, the ground switching device 360, and a ground is formed to be applied with a sustain pulse.

Subsequently, once a sustain switching device 370 and a ground switching device 320 are turned on, a loop including a sustain voltage source Vsz, the Z-electrodes, cells, the diodes D1 to Dn of the scan drivers, a ground switching device 330, and the ground is formed to be supplied with a sustain pulse.

The scan electrode drive unit of the present invention is characterized in employing one switching device for one scan electrode, whereas the related art push-pull structure inevitably employs a pair of the switching devices. In this case, the switching device of the selected scan electrode is turned on, whereas the switching device of the unselected scan electrode is turned off.

In the related art push-pull structure, if one of the switching devices of the unselected scan electrode is turned off, the other switching device is turned on to the ground to bring about power consumption. The present invention is characterized in reducing power consumption in a manner that, when the scan pulse is applied to the scan electrode, a current flows in the selected scan electrode but fails in flowing though the unselected scan electrode.

Figure 4:
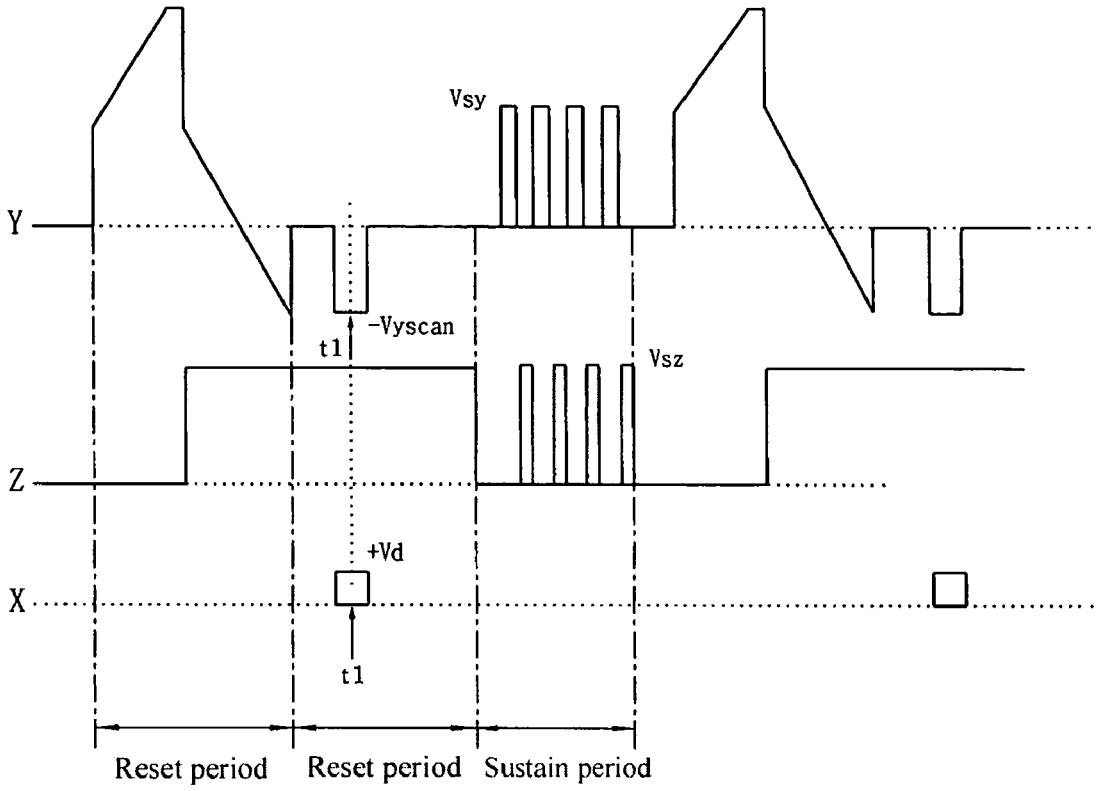
FIG. 4 is a waveform diagram of an apparatus for driving a plasma display panel including a scan driver according to the present invention.

FIG. 4 is a waveform diagram of an apparatus for driving a plasma display panel including a scan driver according to the present invention. Referring to FIG. 4, if one of the switching devices SW1 to SWn of the scan drivers is turned on and if the switching devices of the rest of the scan drivers are turned off, −Vyscan is applied to the Y-electrode corresponding to the specific scan driver and a ground level is applied to the rest of the Y-electrodes. And, +Vd voltage is applied to the X-electrode by being synchronized with the impression of Vyscan on the Y-electrode corresponding to the specific scan driver. Thus, the cell supplied with Vd+Vyscan voltage is selected to perform a data write thereon. And, such a data write is carried out on the entire Y-electrodes.

As the switching device of the selected scan driver is turned on only and the switching devices of the rest of the scan drivers are turned off, the present invention can reduce the power consumption lower than that of the related art. And, the present invention is allowed to use one switching device that is expensive, thereby decreasing the costs and volume of the scan driver.

For instance, if one IC package supports 64 channels, there exist 64 scan drivers. The present invention needs 64 switching devices and 64 diodes only, whereas the related art scan drivers are configured with 128 switching devices and 128 diodes. Hence, a size of the IC package is reduced and its price is cut down by at least 50%.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel comprising:

a data electrode drive unit applying a data pulse to a data electrode;

a scan electrode drive unit provided with a plurality of switching circuits for allowing a current to flow through a first scan electrode but not to flow through a second scan electrode when a scan pulse is applied to correspond to the data pulse applied by the data electrode drive unit, wherein the plurality of switching circuits includes a first switch to control the supply of current through the first scan electrode when selected and to block the flow of current through the first scan electrode when unselected; and a ground diode arranged between the first switch and a ground switch device, the ground diode to allow the first scan electrode to receive the scan pulse when the ground switch device is turned on, the second scan electrode to assume substantially a ground level when the ground switch device is turned on, wherein each of the plurality of the switching circuits comprises only one switching device to apply the scan pulse per one scan electrode, the only one switching device for the first scan electrode corresponding to the first switch.

2. The plasma display panel of claim 1, wherein each of a plurality of the switching circuits turns on the selected scan electrode or turns off the unselected scan electrode.

3. The plasma display panel of claim 1, wherein each of the plurality of the switching circuits comprises only one switching device to apply the scan pulse per one scan electrode, the only one switching device for the first scan electrode corresponding to the first switch.

4. The plasma display panel of claim 1, further comprising a plurality of diodes, each diode turned on to apply a sustain pulse to a corresponding scan electrode in applying the sustain pulse, the diode for the first scan electrode corresponding to the ground diode.

5. The plasma display panel of claim 3, wherein each switching device comprises a field effect transistor (FET).

6. The plasma display panel of claim 3, wherein the switching device for the first scan electrode includes the first switch and applies the scan pulse having a polarity inverse to that of the data pulse applied to the data electrode.

7. The plasma display panel of claim 4, wherein the switching device for an unselected scan electrode is turned off when a corresponding one of the diodes is turned on.

8. The plasma display panel of claim 4, wherein a cathode end of each diode is connected to one end of the switching device of a corresponding scan electrode and wherein an anode end of the diode is connected to the other end of the switching device of the corresponding scan electrode.

9. A plasma display panel comprising:

a data electrode drive unit applying a data pulse to a data electrode;

a scan electrode drive unit provided with a plurality of switching circuits for a plurality of scan electrodes, wherein:

a switching circuit for a first scan electrode includes a first switch which allows a current to flow through the first scan electrode when selected and to block the flow of current through the first scan electrode when unselected, and a switching circuit for a second scan electrode includes a second switch which does not allow current to flow through a second scan electrode when unselected and allows current to flow through the second scan electrode when selected, the first and second scan electrode selected at different times when a scan pulse is applied to correspond to the data pulse applied by the data electrode drive unit; and a ground diodes arranged between respective ones of the switching devices and a ground switch device, each ground diode to allow a corresponding one of the scan electrodes when selected to receive a scan pulse when the ground switch device is turned on, unselected scan electrodes to assume substantially a ground level when the ground switch device is turned on, and wherein each of the plurality of the switching circuits comprises only one switching device to apply the scan pulse per one scan electrode, the only one switching device for the first scan electrode corresponding to the first switch.

10. The plasma display panel of claim 9, wherein the switching device for a selected one of the scan electrodes turns on the selected scan electrode.

11. The plasma display panel of claim 9, further comprising a plurality of diodes provided for the plurality of scan electrodes respectively, wherein each diode is turned on to apply a sustain pulse to a respective one of the scan electrodes in applying the sustain pulse.

12. The plasma display panel of claim 9, wherein each of the switching devices comprises a field effect transistor (FET).

13. The plasma display panel of claim 9, wherein the switching device for a selected one of the scan electrodes applies a scan pulse having a polarity inverse to that of the data pulse applied to the data electrode.

14. The plasma display panel of claim 11, wherein the switching device for an unselected one of the scan electrodes is turned off when a corresponding diode is turned on.

15. The plasma display panel of claim 11, wherein a cathode end of each diode is connected to one end of a corresponding one of the switching devices of a corresponding scan electrode and wherein an anode end of the diode is connected to the other end of the switching device of the corresponding scan electrode.

16. A method of driving a plasma display panel, comprising:

applying a data pulse to a data electrode; and controlling one a plurality of switching circuits provided for a plurality of scan electrodes, wherein:

a switching circuit for a first scan electrode includes a first switch for allowing a current to flow through the selected first scan electrode when selected and to block the flow of current through the first scan electrode when unselected, and a switching circuit for second scan electrode includes a second switch for not allowing current to flow through the second scan electrode when the second scan electrode is unselected and allowing current to flow through the second scan electrode when selected, the first and second scan electrodes selected at different times, applying a scan pulse to correspond to a data pulse for a selected one of the scan electrodes, wherein the selected one of the scan electrodes is allowed to receive the scan pulse based on control of a ground diode between the first switch and a ground switch device when the ground switch device is turned on, and wherein the an unselected one of the scan electrodes is allowed to assume substantially a ground level when the ground switch device is turned on, and wherein each of the plurality of the switching circuits comprises only one switching device to apply the scan pulse per one scan electrode, the only one switching device for the first scan electrode corresponding to the first switch.

17. The method of claim 16, wherein the plasma display panel includes a plurality of diodes, each diode turned on to apply a sustain pulse to a corresponding scan electrode.

18. The method of claim 16, wherein the switching device for a selected one of the scan electrodes applies the scan pulse having a polarity inverse to that of the data pulse applied to the data electrode.

19. The method of claim 17, wherein the switching device for an unselected one of the scan electrodes is turned off when a corresponding one of the diodes is turned on.

20. The plasma display panel of claim 1, further comprising: another ground diode to allow the second scan electrode to assume substantially said ground level when the ground switch device is turned on and the first scan electrode is allowed to receive the scan pulse.

21. The plasma display panel of claim 9, further comprising: another ground diode to allow the second scan electrode to assume substantially said ground level when the ground switch device is turned on and the first scan electrode is allowed to receive the scan pulse.

22. The method of claim 16, wherein the second scan electrode is allowed to assume substantially a ground level through control of another ground diode when the ground switch device is turned on and the first scan electrode is allowed to receive the scan pulse.

23. The plasma display panel of claim 9, wherein the first switch is the only switch provided to control the supply of and block current through the first scan electrode and the second switch is the only switch provided to control the supply of and block current through the second scan electrode apply the scan pulse to each of the plurality of scan electrodes.

24. The method of claim 16, wherein the first switch is the only switch provided to control the supply of and block current through the first scan electrode and the second switch is the only switch provided to control the supply of and block current through the second scan electrode apply the scan pulse to each of the plurality of scan electrodes.

25. The plasma display panel of claim 1, wherein the first switch is coupled to the first scan electrode and a second switch is coupled to the second scan electrode, wherein current flows through the first scan electrode when the first switch is in a first state, the second switch is in a second state, and the first scan electrode is selected, the current prevented from flowing through the second scan electrode when the second switch is in said second state, and wherein current is prevented from flowing through the first scan electrode when the first switch is in said second state and the first scan electrode is unselected.

* * * * *